US006793325B2

(12) United States Patent
Alm

(10) Patent No.: US 6,793,325 B2
(45) Date of Patent: Sep. 21, 2004

(54) DIRECT PRINTING APPARATUS AND METHOD

(75) Inventor: Filip Alm, Bohus (SE)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/433,262

(22) PCT Filed: Dec. 4, 2000

(86) PCT No.: PCT/SE00/02428

§ 371 (c)(1),
(2), (4) Date: Jun. 2, 2003

(87) PCT Pub. No.: WO02/45965

PCT Pub. Date: Jun. 13, 2002

(65) Prior Publication Data

US 2004/0036742 A1 Feb. 26, 2004

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 299, 292–294

(56) References Cited

U.S. PATENT DOCUMENTS 5,984,456 A 11/1999 Bern
6,011,944 A 1/2000 Nilsson
6,176,568 B1 * 1/2001 Nilsson ..... 347/55

FOREIGN PATENT DOCUMENTS

EP 0 851 316 A1 7/1998

OTHER PUBLICATIONS

International Search Report—PCT/SE00/02428; ISA/Swedish Patent Office; Aug. 16, 2001.

* cited by examiner

*Primary Examiner*—Raquel Yvette Gordon
(74) *Attorney, Agent, or Firm*—Harness, Dickey & Pierce, P.L.C.

(57) ABSTRACT

A direct printing method and apparatus in which a computer generated image information is converted into a pattern of electrostatic fields, which selectively transport electrically charged toner particles from a particle source (3) toward a back electrode through a printhead structure including a plurality of appertures and control electrodes arranged in conjunction to the apertures whereby the charged toner particles are deposited in image configuration on an image receiving surface caused to move relative to the printhead structure. Control means is arranged to address an amount of charged toner particles corresponding to at least 35 charged toner particles per addressed dot at least for a part of the image location areas.

30 Claims, 9 Drawing Sheets

DIRECT PRINTING APPARATUS AND METHOD

TECHNICAL FIELD

The invention relates to a direct printing apparatus and method in which a computer generated image information is converted into a pattern of electrostatic fields, which selectively transport electrically charged particles from a particle carrier towards an image receiving surface through a printhead structure, whereby the charged particles are deposited in image configuration on the image receiving surface caused to move relative to the printhead structure.

More particularly, the invention relates to improve the print quality and sharpness of the printed characters in direct printing.

BACKGROUND OF THE INVENTION

U.S. Pat. No. 5,036,341 discloses a direct electrostatic printing device and a method to produce text and pictures with toner particles on an image receiving substrate directly from computer generated signals. Such a device generally includes a printhead structure provided with a plurality of apertures through which toner particles are selectively transported from a particle source to an image receiving medium due to control in accordance with an image information.

The printhead structure according to U.S. Pat. No. 5,036,341 is formed by a lattice consisting in intersecting wires disposed in rows and columns. Each wire is connected to an individual voltage source. Initially the wires are grounded to prevent toner from passing through the wire mesh. As a desired print location on the image receiving substrate passes below an intersection, adjacent wires in a corresponding column and row are set to a print potential to produce an electric field that draws the toner particles from the particle source. The toner particles are propelled through the square aperture formed by four crossed wires and deposited on the image receiving substrate in the desired pattern. A drawback with this construction of printhead structure is that individual wires can be sensitive to the opening and closing of adjacent apertures, resulting in imprecise image formation due to the narrow wire border between apertures.

This effect is mitigated in an arrangement described in U.S. Pat. No. 5,847,733 by the present applicant. This proposes a control electrode array formed on an apertured insulating substrate. A ring electrode is associated with each aperture and is driven to control the opening and closing of the aperture to toner particles. Each aperture is further provided with deflection electrodes. These are controlled to selectively generate an asymmetric electric field around the aperture, causing toner particles to be deflected prior to their deposition on the image-receiving member. This process is referred to as dot deflection control (DDC). This enables each individual aperture to address several dot positions. The print addressability is thus increased without the need for densely spaced apertures.

Although the print quality in direct electrostatic printing is very good there is a continuous need for further improvements.

SUMMARY OF THE INVENTION

Accordingly, the object of the present invention is to improve the print quality and sharpness of the printed characters in a direct electrostatic printing apparatus. In accordance with claim 1, this object is achieved by means of control means that is arranged to address an amount of charged toner particles corresponding to at least 35 charged toner particles per addressed dot at least for a part of the image location areas. It is by that ensured the number of toner particles in the respective dot is sufficient for providing a distinct edge sharpness in that dot.

Further characteristic features and advantages of the invention are disclosed in the description and in the dependant claims.

DETAILED DESCRIPTION OF EMBODIMENTS

Figure 1:
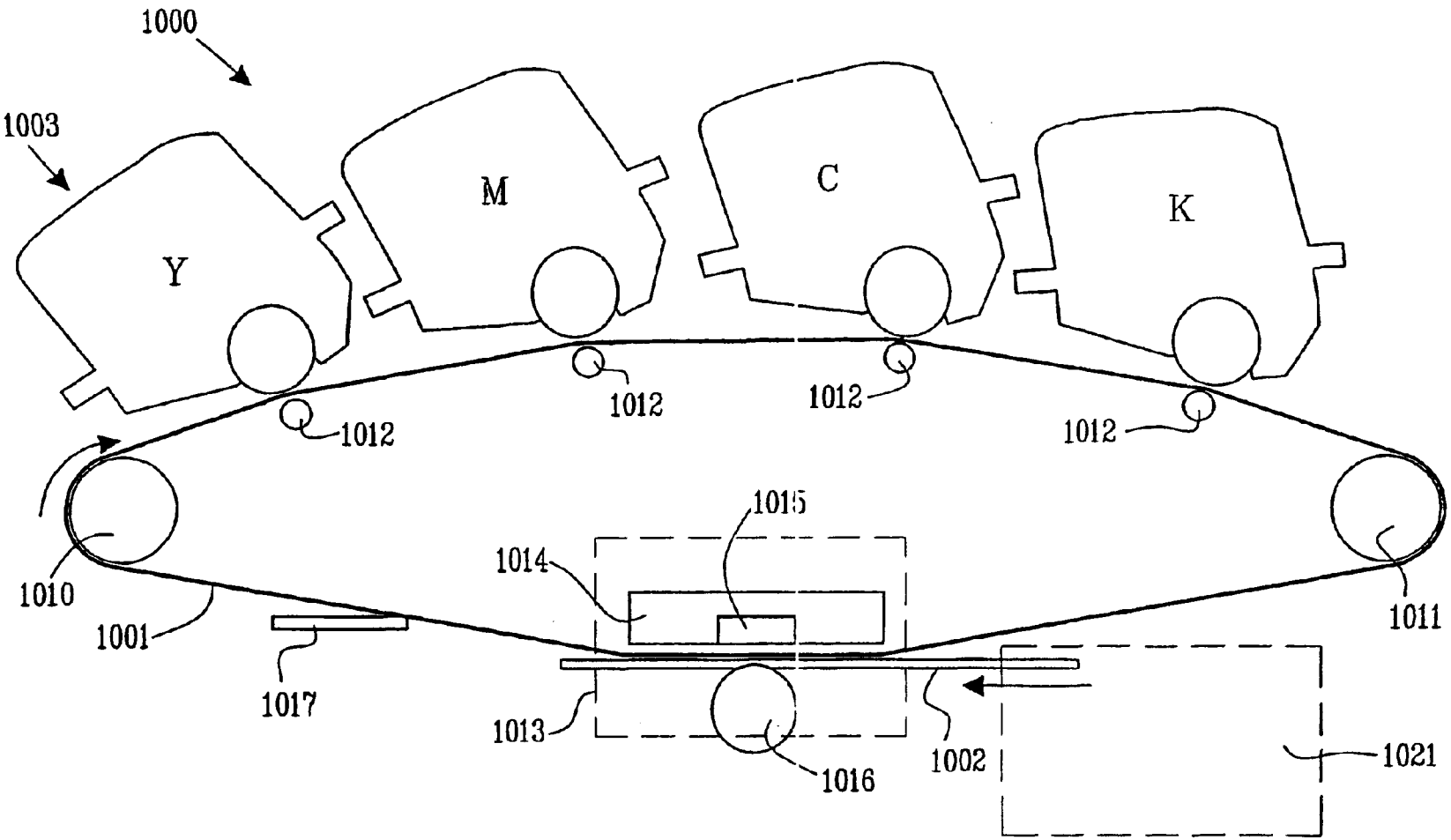
FIG. 1 is a schematic view of an image forming apparatus where an image-receiving surface is provided on a belt arranged in an endless loop.

In order to perform a direct electrostatic printing using the apparatus shown in FIGS. 1–4*c*, a background electric field is produced between a particle carrier and a back electrode to enable a transport of charged particles therebetween. A printhead structure, such as an electrode matrix provided with a plurality of selectable apertures, is interposed in the background electric field between the particle carrier and the back electrode and connected to a control unit which converts the image information into a pattern of electrostatic fields which, due to control in accordance with the image information, selectively open or close passages in the electrode matrix to permit or restrict the transport of charged particles from the particle carrier. The modulated stream of charged particles allowed to pass through the opened apertures are thus exposed to the background electric field and propelled toward the back electrode. The charged particles are deposited on an image receiving surface to provide line-by line scan printing to form a visible image.

A printhead structure for use in direct electrostatic printing may take on many designs, such as a lattice of intersecting wires arranged in rows and columns, or an apertured substrate of electrically insulating material overlaid with a printed circuit of control electrodes arranged in conjunction with the apertures. Generally, a printhead structure includes a flexible substrate of insulating material such as polyimide or the like, having a first surface facing the particle carrier, a second surface facing the back electrode and a plurality of apertures arranged through the substrate. The first surface is coated with an insulating layer and control electrodes are arranged between the first surface of the substrate and the insulating layer, in a configuration such that each control electrode surrounds a corresponding aperture. The apertures are preferably aligned in one or several rows extending transversally across the width of the substrate, i.e. perpendicularly to the motion direction of the image receiving surface.

According to such a method, each single aperture is utilized to address a specific dot position of the image in a transversal direction. Thus the transversal print addressability is limited by the density of apertures through the printhead structure. For instance, a print addressability of 300 dpi requires a printhead structure having 300 apertures per inch in a transversal direction.

Advantageously, a direct electrostatic printing device of the type in question includes a dot deflection control (DDC). Thereby, each single aperture is used to address several dot positions on an image receiving surface by controlling not only the transport of toner particles through the aperture, but also their transport trajectory toward the image receiving surface, and thereby the location of the obtained dot. The DDC method increases the print addressability without requiring a larger number of apertures in the printhead structure. This is achieved by providing the printhead structure with deflection electrodes connected to variable deflection voltages which, during each print cycle, sequentially modify the symmetry of the electrostatic control fields to deflect the modulated stream of toner particles in predetermined deflection directions. For instance, a DDC method performing three deflection steps per print cycle, provides a print addressability of 600 dpi utilizing a printhead structure having only 200 apertures per inch.

An improved DDC method provides a simultaneous dot size and dot position control. This method utilizes the deflection electrodes to influence the convergence of the modulated stream of toner particles thus controlling the dot size. Each aperture is surrounded by two deflection electrodes connected to respective deflection voltages D1, D2, such that the electrostatic control field generated by the control electrode remains substantially symmetrical as long as both deflection voltages D1, D2 have the same amplitude. The amplitude of D1 and D2 are modulated to apply converging forces on toner particles as they are transported toward the image receiving surface, thus providing smaller dots. The dot position is simultaneously controlled by modulating the amplitude difference between D1 and D2 to deflect the toner trajectory toward predetermined dot positions.

A printhead structure for use in DDC methods generally includes a flexible substrate of electrically insulating material such as polyimide or the like, having a first surface facing the particle carrier, a second surface facing the back electrode and a plurality of apertures arranged through the substrate. The first surface is overlaid with a first printed circuit including the control electrodes and the second surface is overlaid with a second printed circuit including the deflection electrodes. Both printed circuits are coated with insulative layers. Utilizing such a method, 60 micrometer dots can be obtained with apertures having a diameter in the order of 160 micrometer.

FIG. 1 shows an image forming apparatus 1000 which comprises at least one print station, preferably four print stations (Y, M, C, K), an intermediate member 1001 providing an image receiving surface, a driving roller 1010, at least one support roller 1011, and preferably several adjustable holding elements 1012. The four print stations are arranged in relation to the intermediate member 1001. The intermediate member, in FIG. 1 a transfer belt 1001, is mounted over the driving roller 1010. The at least one support roller 1011 is provided with a mechanism for maintaining the transfer belt 1001 with a constant tension, while preventing transversal movement of the transfer belt 1001. The holding elements 1012 are for accurately positioning the transfer belt 1001 with respect to each print station.

The driving roller 1010 in FIG. 1 is a cylindrical metallic sleeve having a rotational axis extending perpendicularly to the motion direction of the belt 1001 and a rotation velocity adjusted to convey the belt 1001 at a velocity of one addressable dot location per print cycle, to provide line by line scan printing. The adjustable holding elements 1012 are arranged for maintaining the surface of the belt at a predetermined gap distance from each print station. The holding elements 1012 in FIG. 1 are cylindrical sleeves disposed perpendicularly to the belt motion in an arcuate configuration so as to slightly bend the belt 1001 at least in the vicinity of each print station in order to, in combination with the belt tension, create a stabilization force component on the belt. That stabilization force component is opposite in direction and preferably larger in magnitude than an electrostatic attraction force component acting on the belt 1001 due to interaction with the different electric potentials applied on the corresponding print station.

The transfer belt 1001 in the apparatus shown in FIG. 1 is an endless band of 30 to 200 microns thick composite material as a base. The base composite material can include thermoplastic polyamide resin or any other suitable material having a high thermal resistance, such as 260° C. of glass transition point and 388° C. of melting point, and stable mechanical properties below temperatures in the order of 250° C. The composite material of the transfer belt has a homogeneous concentration of filler material, such as carbon or the like, which provides a uniform electrical conductivity throughout the entire surface of the transfer belt 1001. The outer surface of the transfer belt 1001 in FIG. 1 is coated with a 5 to 30 microns thick coating layer made of electrically conductive polymer material having appropriate conductivity, thermal resistance, adhesion properties, release properties and surface smoothness.

The transfer belt 1001 is conveyed past the four different print stations, whereas toner particles are deposited on the outer surface of the transfer belt and superposed to form a four color toner image. Toner images can then be conveyed through a fuser unit 1013 comprising a fixing holder 1014 arranged transversally in direct contact with the inner surface of the transfer belt. The fixing holder includes a heating element 1015, suitably of a resistance type of e.g. molybdenium, maintained in contact with the inner surface of the transfer belt 1001. As an electric current is passed through the heating element 1015, the fixing holder 1014 reaches a temperature required for melting the toner particles deposited on the outer surface of the transfer belt 1001. The fusing unit 1013 further includes a pressure roller 1016 arranged transversally across the width of the transfer belt 1001 and facing the fixing holder 1014. In the apparatus shown in FIG. 1, an information carrier 1002, such as a sheet of plain untreated paper or any other medium suitable for direct printing, is fed from a paper delivery unit 1021 and conveyed between the pressure roller 1016 and the transfer belt. The pressure roller 1016 rotates with applied pressure to the heated surface of the fixing holder 1014 whereby the melted toner particles are fused on the information carrier 1002 to form a permanent image. After passage through the fusing unit 1013, the transfer belt is brought in contact with a cleaning element 1017, such as for example a replaceable scraper blade of fibrous material extending across the width of the transfer belt 1001 for removing all non-transferred toner particles from the outer surface.

Instead of a single unit performing a combined image transfer and fusing step, separate units for transferring the image to the information carrier and for fusing/fixating the image to the information carrier can be provided. The fusing unit normally is provided with means for feeding the paper to an out-tray, from which the paper can be collected by a user.

Toner particles are retained on the surface of a particle carrier (e.g. 1033 in FIGS. 2–3) by an adhesion force which essentially is related to the particle charge and to the distance between the particle and the surface of the particle carrier. The electrostatic field applied onto a control electrode to initiate toner transport through a selected aperture is selected to be sufficient to overcome the adhesion force in order to cause the release of an appropriate amount of toner particles from the particle carrier. The electrostatic field is applied during the time period required for these released particles to reach sufficient momentum to pass through the selected aperture, whereafter the transported toner particles are exposed to the attraction force from the back electrode and are intercepted by the image receiving surface.

Properties such as charge amount, charge distribution, particle diameter etc. of the individual toner particles have been found to be of particularly great importance to the print performance in a direct printing method. Accordingly, the size and size distribution of the toner particles affect the printing result, since larger toner particles have a tendency to cause clogging of the apertures in the control electrode array. In addition, the toner particles allowed to pass through selected "opened" apertures are accelerated towards the image receiving under the influence of a uniform attraction field from the back electrode. In order to control the distribution of the transported particles onto a printing surface, the particles may be deflected by the application of a deflection pulse, resulting in an increase in the addressable area on the image receiving surface. Thereby, small particles having a low surface charge exhibit poor deflection properties.

Normally, toner particles are produced by the so-called melt-crushed method, which involves crushing and classifying coloured resin with dispersed colouring agents and other additives using a compounding process. However, this method is not ideally suited for producing small-particle toner since it has a relatively low yield, and tends to produce a great variety of particle sizes and toner particles with a non-uniform composition. A non-uniform toner results in a poor charge uniformity and may impair the print quality.

Toner particles can also be produced in a chemical polymerization process, which is better suited for producing small toner particles of a uniform size. There are three basic processes, i.e. the suspension polymerization method, the dispersion polymerization method, and the emulsion polymerization method. The suspension and dispersion polymerization methods produce full-shaped spherical toner particles with a size between a few and up to 10 microns. The emulsion polymerization method produces polymer particles of sub-micron size or smaller, which particles are aggregated by means of different methods, e.g. heat-welding or coagulation, in order to form micron-order particles. The shape of the aggregated particles can vary from grape cluster to spherical, depending on the conditions prevailing in the aggregation process.

Toner particles can comprise a number of ingredients, e.g. a binding resin based on a cyclic polyolefin e.g. a copolymer of an alicyclic compound with double bonds, such as cyclohexene or norbornene, and an alpha-olefin, such as ethylene, propylene or butylene. Accordingly, the toner particles can be of 2-component or multi-component type.

Toner for use in direct printing can be of a multi-component type comprising a suitable toner carrier, e.g. in the form of carrier beads which are recirculated within the toner supply system when printing. In addition to toner resin and toner carrier, multi-component toner can comprise different colorants, charge control agents, magnetic additives, bulk additives, surface additives, conductive additives, etc. Advantageously, the toner particles have an irregular surface structure and an average diameter within the range of 3–8 microns. Depending on the application in question, electrically conductive, electrically non-conductive, non-magnetic, or magnetic toner particles can be provided and utilized.

Figure 2:
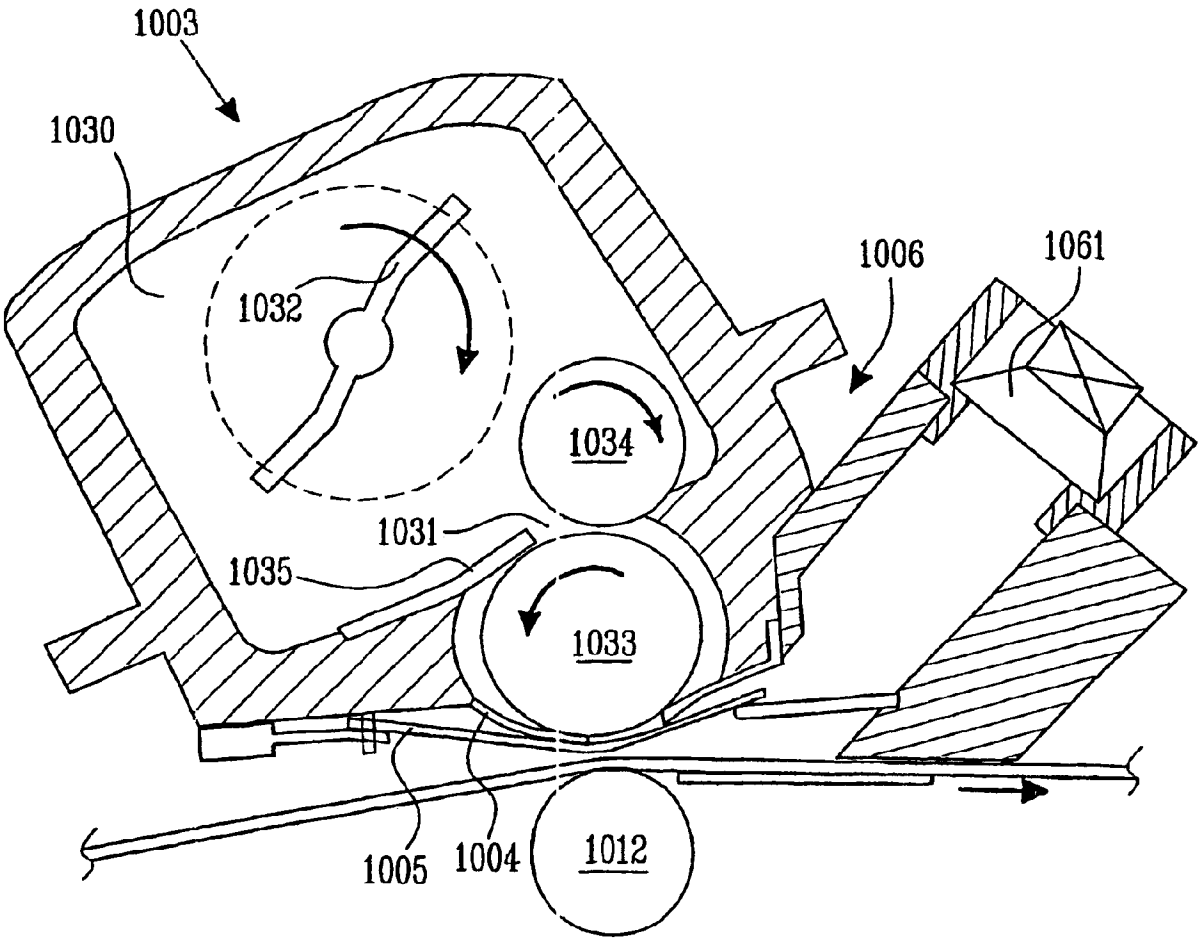
FIG. 2 is a schematic sectional view across a print station in an image forming apparatus, such as, for example, that shown in FIG. 1.

As shown in FIG. 2, a print station of an image forming apparatus, e.g. the one shown in FIG. 1, includes a particle delivery unit 1003 advantageously having a replaceable or refillable container 1030 for holding toner particles, the container 1030 having front and back walls (not shown), a pair of side walls and a bottom wall having an elongated opening 1031 extending from the front wall to the back wall and provided with a toner feeding element 1032 disposed to continuously supply toner particles to a sleeve 1033 through a particle charging member 1034. The particle charging member 1034 is advantageously formed of a supply brush or a roller made of or coated with a fibrous, resilient material. The supply brush is brought into mechanical contact with the peripheral surface of the sleeve 1033 for charging particles by contact charge exchange due to triboelectrification of the toner particles through frictional interaction between the fibrous material on the supply brush and any suitable coating material of the sleeve. The sleeve 1033 is advantageously made of metal coated with a conductive material, and advantageously has a substantially cylindrical shape and a rotational axis extending parallel to the elongated opening 1031 of the particle container 1030. Charged toner particles are held to the surface of the sleeve 1033 by electrostatic forces essentially proportional to $(Q/D)^2$, where Q is the particle charge and D is the distance between the particle charge center and the boundary of the sleeve 1033. Alternatively, the charge unit may additionally include a charging voltage source (not shown), which supply an electric field to induce or inject charge to the toner particles.

Although it is most advantageous to charge particles through contact charge exchange, the method can also be performed using any other suitable charge unit, such as a conventional charge injection unit, a charge induction unit or a corona charging unit.

A metering element 1035 is positioned proximate to the sleeve 1033 to adjust the concentration of toner particles on the peripheral surface of the sleeve 1033, to form a relatively thin, uniform particle layer thereon. The metering element 1035 may be formed of a flexible or rigid, insulating or metallic blade, roller or any other member suitable for providing a uniform particle layer thickness. The metering element 1035 may also be connected to a metering voltage source (not shown) which influences the triboelectrification of the particle layer to ensure a uniform particle charge density on the surface of the sleeve The particle charging member and the metering element can be of different designs and materials. The particle charging member, for instance, can be made of or comprise a polymeric foam material instead of a fibrous, resilient material.

Figure 3:
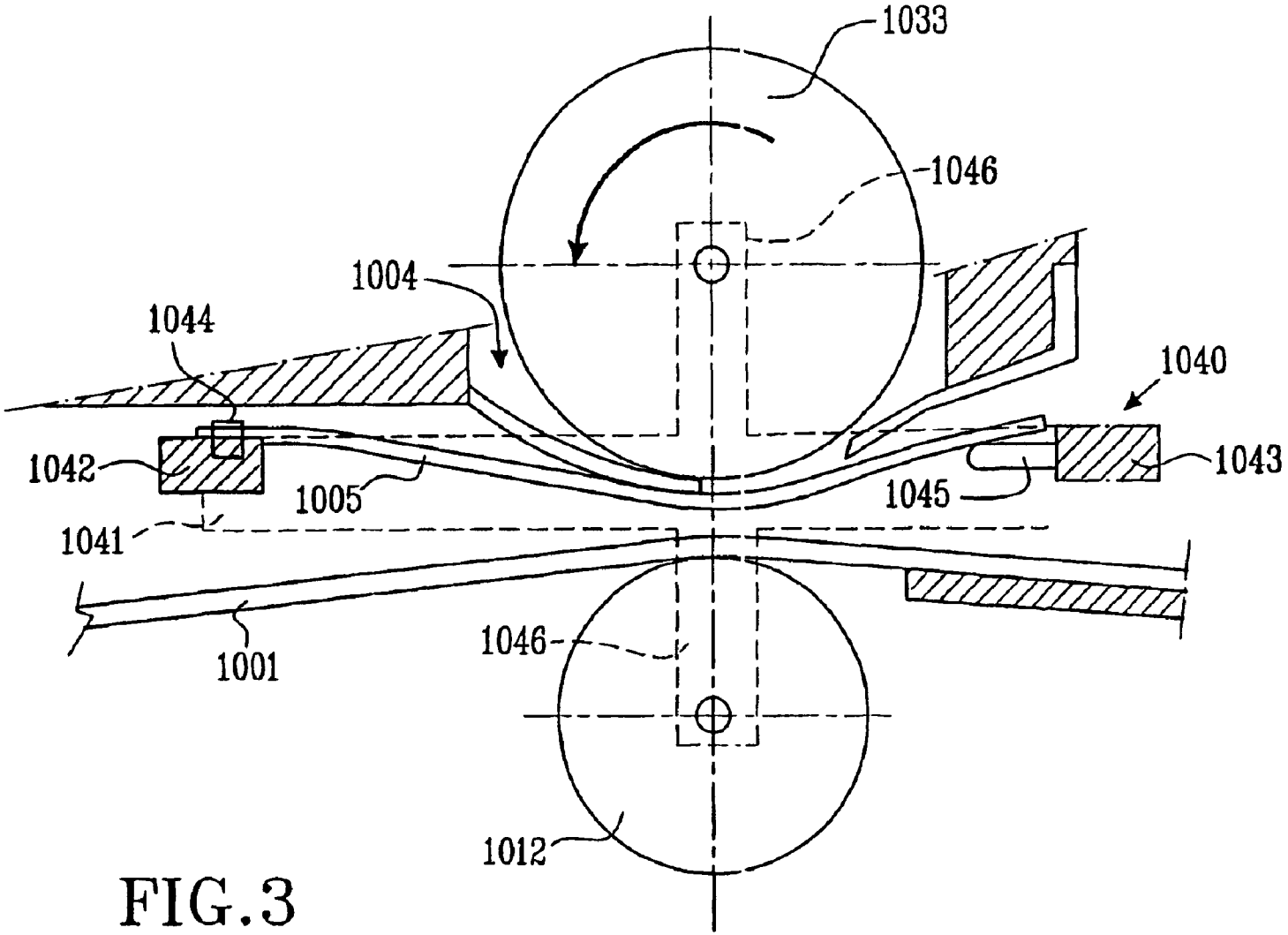
FIG. 3 is a schematic sectional view of the print zone, illustrating the positioning of a printhead structure in relation to a particle source and an image-receiving surface.

In FIG. 3, the sleeve 1033 is arranged in relation to a positioning device 1040 for accurately supporting and maintaining the printhead structure 1005 in a predetermined position with respect to the peripheral surface of the sleeve 1033. The positioning device 1040 is formed of a frame 1041 having a front portion, a back portion and two transversally extending side rulers 1042, 1043 disposed on each side of the sleeve 1033 parallel to the rotational axis thereof. The first side ruler 1042, positioned at a upstream side of the sleeve 1033 with respect to its rotation direction, is provided with fastening means 1044 to secure the printhead structure 1005 along a transversal fastening axis extending across the entire width of the printhead structure 1005. The second side ruler 1043, positioned at a downstream side of the sleeve 1033, is provided with a support element 1045, or pivot, for supporting the printhead structure 1005 in a predetermined position with respect to the peripheral surface of the sleeve 1033. The support element 1045 and the fastening axis are so positioned with respect to one another, that the printhead structure 1005 is maintained in an arcuate shape along at least a part of its longitudinal extension. That arcuate shape has a curvature radius determined by the relative positions of the support element 1045 and the fastening axis, and is dimensioned to maintain a part of the printhead structure 1005 curved around a corresponding part of the peripheral surface of the sleeve 1033. The support element 1045 is arranged in contact with the printhead structure 1005 at a fixed support location on its longitudinal axis so as to allow a slight variation of the printhead structure 1005 position in both longitudinal and transversal direction about that fixed support location, in order to accommodate a possible excentricity or any other undesired variations of the sleeve 1033. That is, the support element 1045 is arranged to make the printhead structure 1005 pivotable about a fixed point to ensure that the distance between the printhead structure 1005 and the peripheral surface of the sleeve 1033 remains constant along the whole transverse direction at every moment of the print process, regardless of undesired mechanical imperfections of the sleeve 1033. The front and back portions of the positioning device 1040 are provided with securing members 1046 on which the toner delivery unit 1003 is mounted in a fixed position to provide a constant distance between the rotational axis of the sleeve 1033 and a transversal axis of the printhead structure 1005. Preferably, the securing members 1046 are arranged at the front and back ends of the sleeve 1033 to accurately space the sleeve 1033 from the corresponding holding element 1012 of the transfer belt 1001 facing the actual print station. The securing members 1046 are preferably dimensioned to provide and maintain a parallel relation between the rotation axis of the sleeve 1033 and a central transversal axis of the corresponding holding member 1012.

Figure 4C:
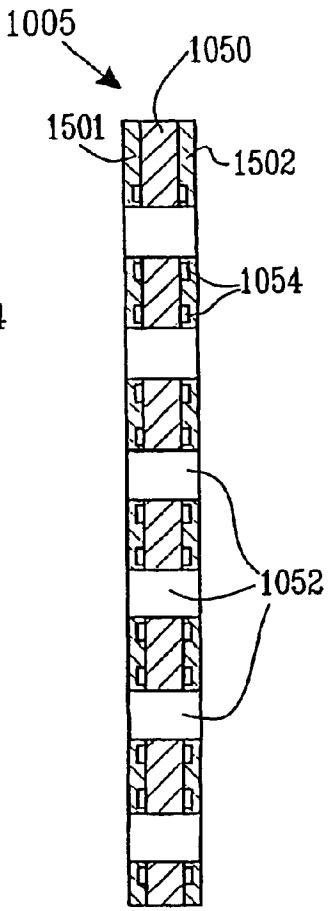
FIG. 4*c* is a sectional view across a section line I—I in the printhead structure of FIG. 4*a* and across the corresponding section line II—II of FIG. 4*b*.
Figure 4B:
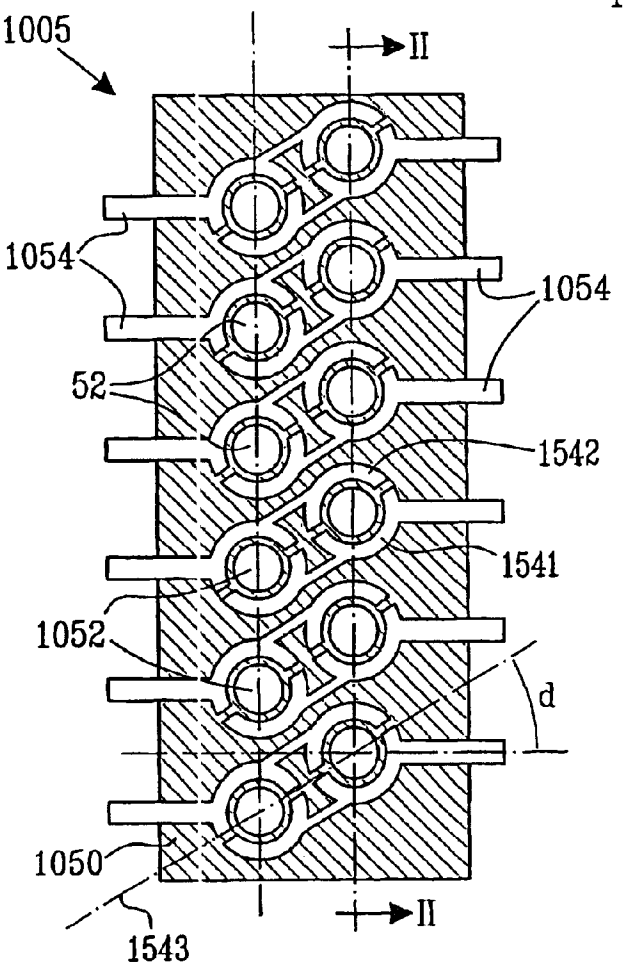
FIG. 4*b* is a partial view of a printhead structure of a type used in an image forming apparatus, showing the surface of the printhead structure that is facing an image receiving surface.
Figure 4A:
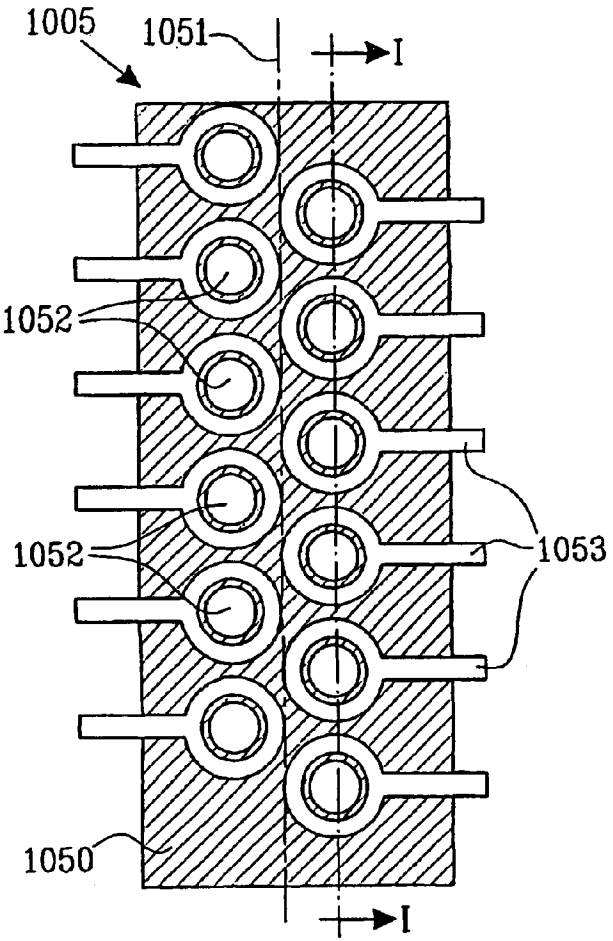
FIG. 4*a* is a partial view of a printhead structure of a type used in an image forming apparatus, showing the surface of the printhead structure that is facing the toner delivery unit.

As shown in FIGS. 4*a*, 4*b*, 4*c*, a printhead structure 1005 in an image forming apparatus, e.g. of the type illustrated in FIG. 1, can comprise a substrate 1050 of flexible, electrically insulating material such as polyimide or the like, having a predetermined thickness, a first surface facing the sleeve (particle carrier), a second surface facing the transfer belt, a transversal axis 1051 extending parallel to the rotation axis of the sleeve 1033 across the whole print area, and a plurality of apertures 1052 arranged through the substrate 1050 from the first to the second surface thereof. The first surface of the substrate is coated with a first cover layer 1501 of electrically insulating material, such as for example parylene. A first printed circuit, comprising a plurality of control electrodes 1053 disposed in conjunction with the apertures, and, in some embodiments, shield electrode structures (not shown) arranged in conjunction with the control electrodes 1053, is arranged between the substrate 1050 and the first cover layer 1501. The second surface of the substrate is coated with a second cover layer 1502 of electrically insulating material, such as for example parylene. A second printed circuit, including a plurality of deflection electrodes 1054, is arranged between the substrate 1050 and the second cover layer 1502. The printhead structure 1005 further includes a layer of antistatic material (not shown), preferably a semiconductive material, such as silicium oxide or the like, arranged on at least a part of the second cover layer 1502, facing the transfer belt 1001. The printhead structure 1005 is brought in cooperation with a control unit (not shown) comprising variable control voltage sources connected to the control electrodes 1053 to supply control potentials which control the amount of toner particles to be transported through the corresponding aperture 1052 during each print sequence. The control unit further comprises deflection voltage sources (not shown) connected to the deflection electrodes 1054 to supply deflection voltage pulses which controls the convergence and the trajectory path of the toner particles allowed to pass through the corresponding apertures 1052. In some designs, the control unit also includes a shield voltage source (not shown) connected to the shield electrodes to supply a shield potential which electrostatically screens adjacent control electrodes 1053 from one another, preventing electrical interaction therebetween. The substrate 1050 is advantageously a flexible sheet of polyimide having a thickness on the order of about 50 microns. The first and second printed circuits are copper circuits of approximately 8–9 microns thickness etched onto the first and second surface of the substrate 1050, respectively, using conventional etching techniques. The first and second cover layers 1501, 1502 are 5 to 10 microns thick parylene laminated onto the substrate 1050 using vacuum deposition techniques. The apertures 1052 are made through the printhead structure 1005 using conventional laser micromachining methods. The apertures 1052 have preferably a circular or elongated shape centered about a axis, with a diameter in a range of 80 to 120 microns, alternatively a transversal minor diameter of about 80 microns and a longitudinal major diameter of about 120 microns. Although the apertures 1052 preferably have a constant shape along their axis, for example cylindrical apertures, it may be advantageous in some embodiments to provide apertures whose shape varies continuously or stepwise along the axis, for example conical apertures.

In one advantageous design, the printhead structure 1005 is dimensioned to perform 600 dpi printing utilizing three deflection sequences in each print cycle, i.e. three dot locations are addressable through each aperture 1052 of the printhead structure during each print cycle. Accordingly, one aperture 1052 is provided for every third dot location in a transverse direction, that is, 200 equally spaced apertures per inch aligned parallel to the transversal axis 1051 of the printhead structure 1005. The apertures 1052 are generally aligned in one or several rows, preferably in two parallel rows each comprising 100 apertures per inch. Hence, the aperture pitch, i.e. the distance between the axes of two neighbouring apertures of a same row is 0.01 inch or about 254 microns. The aperture rows are preferably positioned on each side of the transversal axis 1051 of the printhead structure 1005 and transversally shifted with respect to each other such that all apertures are equally spaced in a transverse direction. The distance between the aperture rows is preferably chosen to correspond to a whole number of dot locations.

The first printed circuit comprises control electrodes 1053 each of which having a ring shaped structure surrounding the periphery of a corresponding aperture 1052, and a connector preferably extending in the longitudinal direction, connecting the ring shaped structure to a corresponding control voltage source. Although a ring-shaped structure is preferred, the control electrodes 1053 may take on various shapes for continuously or partly surrounding the apertures 1052, preferably shapes having symmetry about the axis of the apertures. In some embodiments, particularly when the apertures 1052 are aligned in one single row, the control electrodes are advantageously made smaller in a transverse direction than in a longitudinal direction.

The second printed circuit comprises a plurality of deflection electrodes 1054, each of which is divided into two semicircular or crescent shaped deflection segments 1541, 1542 spaced around a predetermined portion of the circumference of a corresponding aperture 1052. The deflection segments 1541, 1542 are arranged symmetrically about the axis of the aperture 1052 on each side of a deflection axis 1543 extending through the center of the aperture 1052 at a predetermined deflection angle d to the longitudinal direction. The deflection axis 1543 is dimensioned in accordance with the number of deflection sequences to be performed in each print cycle in order to neutralize the effects of the belt motion during the print cycle, to obtain transversally aligned dot positions on the transfer belt. For instance, when using three deflection sequences, an appropriate deflection angle is chosen to arctan(⅓), i.e. about 18.4°. Accordingly, the first dot is deflected slightly upstream with respect to the belt motion, the second dot is undeflected and the third dot is deflected slightly downstream with respect to the belt motion, thereby obtaining a transversal alignment of the printed dots on the transfer belt. Accordingly, each deflection electrode 1054 has a upstream segment 1541 and a downstream segment 1542, all upstream segments 1541 being connected to a first deflection voltage source D1, and all downstream segments 1542 being connected to a second deflection voltage source D2. Three deflection sequences (for instance: D1<D2; D1=D2; D1>D2) can be preformed in each print cycle, whereby the difference between D1 and D2 determines the deflection trajectory of the toner stream through each aperture 1052, thus the dot position on the toner image.

The printhead structure can be of a number of different designs and materials. For instance, instead of being deposited onto the substrate by means of vacuum deposition techniques, the cover layers may be constituted of a 5–20 micron thick film laminated onto the substrate. Furthermore, the printhead structure will of course need no deflection electrodes in applications where no dot deflection control is utilized.

Figure 5:
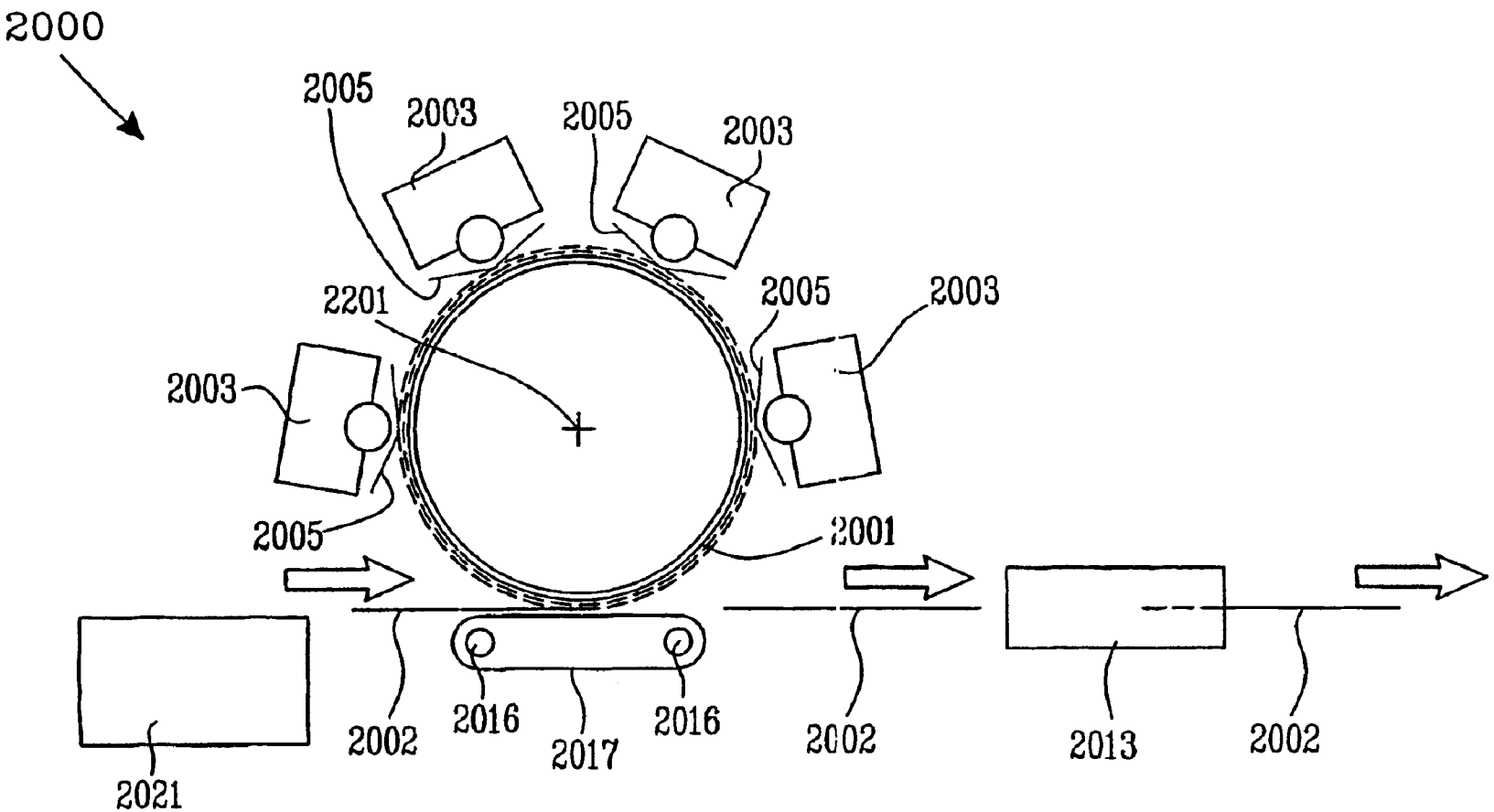
FIG. 5 is a schematic side view of an image forming apparatus where the image receiving surface is provided on a shell of a cylindrical drum.

FIG. 5 is a schematic, simplified view of an image forming apparatus 2000 where the image receiving surface is provided on a cylindrical drum 2001. The image forming apparatus comprises one or several print stations 2003, each adapted for printing one color. Normally, the colors being used are yellow, magenta, cyan and black. Each print station 2003 advantageously has the form of an elongated cartridge assembly and is arranged adjacent to a printhead structure 2005, providing an electrode matrix with a plurality of selectable apertures, which is interposed in a background electric field defined between the corresponding cartridge 2003 and a back electrode, which will the image forming apparatus in FIG. 5 is constituted of the cylindrical drum 2001. The drum 2001 is arranged so as to rotate during operation of the image forming apparatus. To this end, the drum 2001 is powered by drive means (not shown in FIG. 5). Furthermore, the drum 2001 has a circumference which is slightly greater than the length of the paper (or other information carrier) used during printing. The drum 2001 advantageously is made of aluminum, but can also be made from other materials with suitable properties.

Each printhead 2005 is connected to a control unit (not shown in FIG. 5) which converts the image information in question into a pattern of electrostatic fields so as to selectively open or close passages in the electrode matrix to permit or restrict the transport of charged toner particles from the corresponding cartridge 2003. In this manner, charged particles are allowed to pass through the opened apertures and toward the back electrode, i.e. the drum 2001. The charged toner particles are then deposited on the surface of the drum 2001. Accordingly, in the image forming apparatus in FIG. 5, the drum 2001 constitutes both back electrode and image receiving surface.

Due to the fact that the drum 2001 is rotating during operation, the image being formed on the drum is then transferred onto an information carrier 2002, such as a sheet of printing paper or any other medium suitable for printing. The paper sheet 2002 is fed from a paper delivery unit 2021 and is conveyed past the underside of the drum 2001. In order to transfer the image to the paper sheet 2002, it is pressed into contact with the drum 2001 by means of belt 2017, which in turn is driven by means of two rollers 2016 around which the belt extends. In this manner, the toner particles are deposited on the outer surface of the drum 2001 and then superimposed to the paper sheet 2002 to form a four-color image.

Accordingly, the operation of the belt 2017 defines a transfer step, which advantageously is positioned in the lowest section of the image receiving surface on the drum 2001. As a result, the force of gravity acting upon the toner particles will contribute to the transfer of said particles from the image receiving surface to the paper sheet 2002 during operation.

After the image has been formed on the paper sheet 2002 by said charged particles, the paper sheet 2002 is fed to a fusing unit 2013, in which the image is permanently fixed onto the paper sheet 2002. In particular, the fusing unit 2013 comprise a fixing holder (not shown) which includes a heating element, advantageously of a resistance type of e.g. molybdenium. As an electric current is passed through the heating element, the fixing holder reaches a temperature required for melting the toner particles deposited on the paper sheet 2002. The fusing unit 2013 further includes a pressure roller (not shown) arranged transversally across the width of the paper sheet 2002. Additionally, the fusing unit 2013 is provided with means for feeding the paper 2002 to an out-tray (not shown) from which the paper 2002 can be collected by a user.

Furthermore, after passage through the fusing unit 2013, the paper sheet 2002 can be brought in contact with a cleaning element (not shown), such as for example a replaceable scraper blade of fibrous material extending across the width of the paper sheet 2002 (or another suitable information carrier), for removing non-transferred toner particles from the paper sheet 2002.

The print stations 2003 and the printhead structures 2005 are mounted in a housing element (not shown in FIG. 5), so that they are maintained in predetermined positions with respect to the drum 2001.

An image forming apparatus of the type shown in FIG. 5 is particularly well suited for direct printing with multi-pass methods by means of which the resolution given by a printhead structure for a given number of apertures may be increased. In order to achieve a print resolution greater than the number of apertures in the printhead structure 2005, multi-pass printing takes place during two or more passes of the image receiving surface provided by the drum 2001, wherein a plurality of longitudinal columns of print are deposited in each pass. A column of print is a longitudinal line of the image receiving surface which is subject to printing of dots by an aperture or apertures even if not all the parts of the line receive dots due to the content of the image being formed requiring some parts of the columns to be left without dots. A transverse line of print is a transverse line of the image receiving surface which is subject to printing of dots from a plurality of apertures, even if not all the parts of the line receive dots due to the content of the image being formed requiring some parts to be left without dots. The closest distance between two adjacent columns of lines of print is defined as the pitch or the distance between two addressable pixel locations. After the first pass, the next passes may be in the same or opposite longitudinal directions to that of the first pass.

The transverse direction is the direction which, in case the image receiving surface is provided on a cylindrical drum, is perpendicular to a radial vector of the cylinder towards the printhead structure at the surface of the drum and parallel to the axis of rotation of the drum along the surface of the drum. In case the image receiving surface is provided on a transfer belt, the transverse direction is the direction in the plane of the belt perpendicular to the movement of the belt, wherein said movement is the movement required to allow the belt to move around two rollers (not shown). Thus, the transverse direction will normally be parallel to the axes of these rollers. The longitudinal direction is the direction perpendicular to the transverse direction and in the plane of the image receiving surface, i.e. transfer belt or drum. In the case of the drum, the longitudinal direction is the direction perpendicular to the transverse direction and along the surface of the drum. In the case of transfer belt, the longitudinal direction is the direction at any point on its surface in the direction perpendicular to the axis of rotation of the rollers and in the plane of the surface of the belt.

With respect to the description which follows, reference is made to image or printable area. In the present context, an image is formed by the toner particles over an area of the image receiving surface. The image also includes those printable areas that could receive toner particles but do not receive the particles because the content of the image does not require this. Typically, an image covers approximately the area of an A4 sheet of paper, though possibly reduced by a small area around the margins that is not printed. The image may for example comprise a plurality of pictures or printed areas which would be printed on the same sheet of paper. Although reference is made to A4 paper, this is not limiting as the image could be the size of A3, or A5 or any other chosen paper size.

Figure 6:
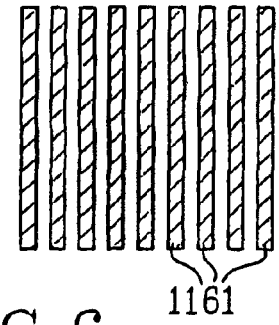
FIG. 6 is a schematic illustration of the columns of print printed in a single pass in a two-pass method.
Figure 7:
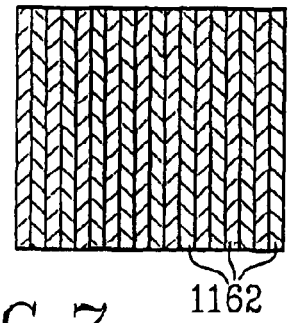
FIG. 7 is a schematic illustration of the columns of print shown in FIG. 6 but after a additional, second pass.

When performing direct printing with two passes in the same direction, the number of apertures per unit length is half of that needed to achieve the desired resolution with a single pass. In a first pass, a first half of the image is formed on the image receiving surface. This first half of the image comprises alternate longitudinal columns of print of the intended final image, i.e. alternate columns are printed and alternate are not printed. The image receiving surface and the printhead in question are then moved relative to each other in the direction transverse to the direction of movement of the plane of the image receiving surface. This relative movement may be carried out by any suitable means known to the person skilled in the art. Then, in a second pass, the remaining columns of print are printed to form the complete image. The second pass can be carried out with the image receiving surface traveling in the same longitudinal direction as the first pass or in the opposite longitudinal direction. This effect is illustrated in FIGS. 6 and 7. The areas that are printed in the first pass are shown in FIG. 6 as hatched areas 1161. FIG. 7 represents the same section of the image receiving surface after the second pass. The areas that are printed in the second pass are shown as differently hatched areas 1162.

Figure 8:
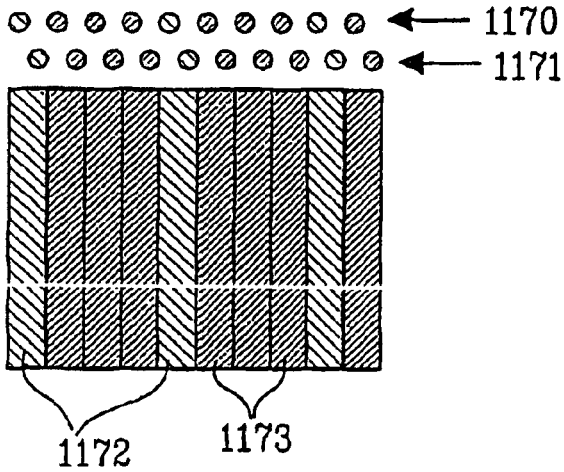
FIG. 8 is a schematic illustration of the effect of apertures which print with a lower density in a two-pass printing method.

The density of a dot, i.e. the quantity of toner particles used to form the dot, may vary according to the position of the aperture on the printhead structure due to an insufficient available amount of toner particles. This is known as the starvation effect. The variation in dot density may take place between apertures within the same row and/or between apertures in different rows. In the discussed example, there is only one row of apertures and the row is moved transversely by one dot pitch between the two passes. In this case, pairs of adjacent rows will be printed by the same aperture. This is illustrated in FIG. 8 in which the first positions of the apertures are indicated by the reference numeral 1170, while the positions of the same apertures during a second pass are indicated by the reference numeral 1171. Thereby, each aperture prints a double column of print by printing two adjacent columns. If, for example, every fourth aperture suffered from the above-mentioned starvation effect, these apertures would produce columns of print having a lower optical density than the columns produced by the remaining apertures. If the row of apertures is moved transversely by one dot pitch, then the adjacent column will be printed in lower density. The result is then a column of a width that is double the width which would be due to printing by a single aperture. Such a double width column is more visible to a viewer. Columns of lesser density produced each by a single aperture in two passes are lighter shaded and indicated by reference numeral 1172 in FIG. 8, while columns of greater density produced by a single aperture in two passes are heavier shaded and are indicated by reference numeral 1173 in FIG. 8.

Figure 9:
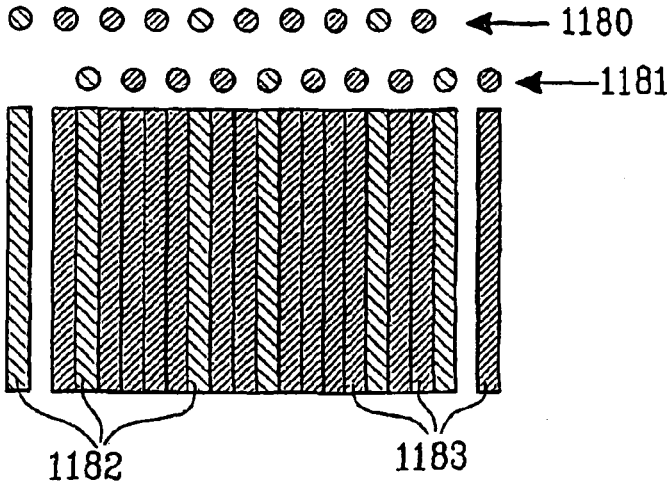
FIG. 9 is a schematic illustration of a first printing pattern.

In order to reduce this "starvation" problem, the row of apertures can be moved transversely with more than one dot pitch between the passes, as illustrated in FIG. 9. The row is moved transversely by an amount equal to 2N+3 number of times the transverse pitch length L, where N is an integer including 0. N will have a maximum value dependent upon the number of apertures and the width of the image to be printed such that the transverse movement leaves enough apertures available to print the image. The pitch length L is the distance between adjacent dots. For 600 dpi (dots per inch), the pitch length is approximately 42 microns. The movement for one row of apertures printing in two passes at 600 dpi is approximately 42 microns. The movement for one row of apertures printing in two passes at 600 dpi is approximately 127 microns or a higher integer multiple as specified in the preceding formula. This is illustrated in FIG. 9 where the row of apertures has moved from first position indicated by reference numeral 1180 in which the first pass took place, to the position indicated by reference numeral 1181 in which the second pass took place. The apertures that are lighter shaded represent apertures that produce dots having lower density, while columns that are lighter shaded represent columns of print that have a lower density. Columns of lesser density produced by a single aperture in two passes are indicated by reference numeral 1182 and columns of greater density each produced by a single aperture in two passes are indicated by reference numeral 1183 in FIG. 9. As can be seen from FIG. 9, the columns of less density 1182 are of narrower width than those 1172 in FIG. 8 and therefore less visible to a viewer. As is evident from the areas at the lateral sides of the image in FIG. 9, not every column of print may be printable by an aperture. The number of apertures in a row is chosen such that not all the apertures are needed to print the intended image. The printing from apertures at the end of the rows which are outside the area to be printed is the suppressed.

Figure 10:
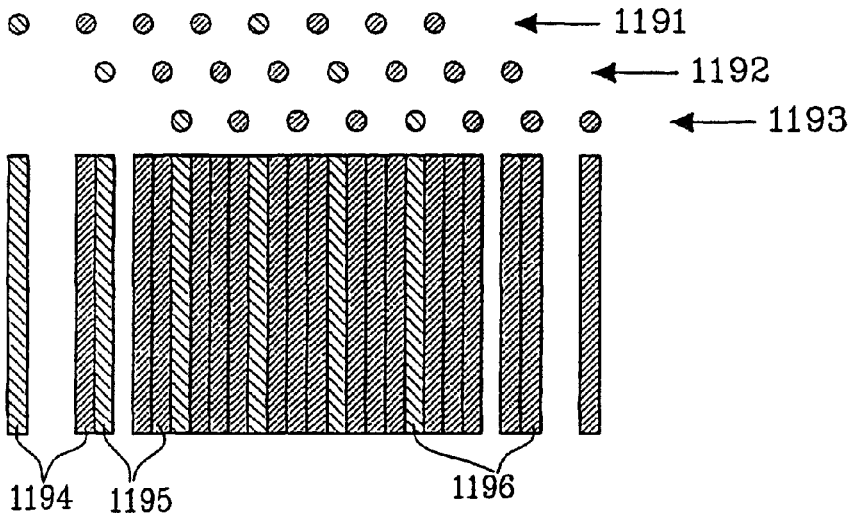
FIG. 10 is a schematic illustration of a second printing pattern.

FIG. 10 is a schematic depiction of printing in three passes. In FIG. 10, the row of apertures has moved from the first position indicated by reference numeral 1191 in which the first pass took place to the position indicated by reference numeral 1192 in which the second pass took place and then to the position indicated by reference numeral 1193. The number of apertures per unit of length transversely is one third of that needed for achieving the same resolution in a single pass. In a first pass a first one third of the image is formed. This first third of columns of print is indicated by reference numeral 1194. The image receiving surface and the printhead structure are then moved relative to each other in the direction transverse to the printing direction but in the plane of the image receiving surface, preferably by moving the drum (or belt) transversely. Then, in a second pass, a second set of columns of the image indicated by reference numeral 1195 are printed. The printhead structure is moved transversely by an amount equal to 3N+2 number of times the transverse pitch length, where N is an integer including 0. N will have a maximum value dependent upon the number of apertures and the width of the image to be printed such that the transverse movement leaves enough apertures available to print the image. The second pass can occur with the belt traveling in the same longitudinal direction as the second pass or in the opposite longitudinal direction. In a third and final pass, the remainder of the columns of the image indicated by reference numeral 1196 are printed. Between the second and third pass the printhead structure is moved transversely by an amount equal to 3N+2 number of times the transverse pitch length L, where N is an integer including 0. N will have a maximum value dependent upon the number of apertures and the width of the image to be printed such that the transverse movement leaves enough apertures available to print the image. The third pass can occur with the image receiving surface traveling in the same direction as the first pass or in the opposite direction. FIG. 10 schematically depicts the image receiving surface at the end of the third pass. The apertures that are lighter shaded represent apertures that produce dots having lower density. The columns that are lighter shaded represent columns of print that have a lower density. As can be seen these columns of lower density are not adjacent each other. Between each pass the row of apertures has been moved transversely by an amount equal to 3N+2 number of times the transverse pitch length L. Alternatively, the row could be moved transversely by an amount equal to 3N+4 number of times the transverse pitch length between each pass where N is an integer including 0. The number and transverse extent of the apertures in a row is chosen such that not all the apertures are needed to print the intended image. The printing from apertures at the end of the rows which are outside the area to be printed is then suppressed. The apparatus may be arranged such that the non-used apertures are at both ends of the row or rows of apertures and during a pass an aperture or apertures at both ends are simultaneously not used.

In general, for printhead structures having a single row of apertures the movement could at least be PN+P+1 or PN+P−1 times the pitch length where P is number of passes needed to complete an image, and N is an integer including 0. However for certain numbers of passes there may be more allowable movement possibilities. So for 5 passes the movements may be 5*N+X times the pitch length where X may be 2, 3, 4 or 6, and N is an integer including 0. In this case the values of X=4 and 6 correspond to the general formula, whereas the values of X=2 and X=3 are extra values. Furthermore for 7 passes the movements may be 7*N+X times the pitch length where X may be 2, 3, 4, 5, 6 or 8 and N is an integer including 0. In this case the values of X=6 and 8 correspond to the general formula, whereas the values of X=2, 3, 4 or 5 are extra values. Extra values in particular occur where the number of passes is a prime number. In this case the number of pitch lengths may be neither 1 nor an integer multiple of 7.

The printhead structure may comprise one or more transverse rows of apertures. The number of apertures in each transverse row may be equal or unequal. The pitch between each aperture in a row may be equal or unequal. The pitch between apertures in a row may be the same in each row, or different rows may contain apertures with different pitches. The apertures in one row are in staggered relationship with the apertures of another row. In a printhead structure containing two rows of apertures the apertures in one row may be arranged to be centered between the apertures of the other row. Alternatively the apertures of one row may arranged to be off centre relative to the apertures of the other row, whilst avoiding being in longitudinal alignment. There may alternatively three or more rows of apertures per printhead. The number of rows of apertures may be the same on each printhead or different.

Figure 11:
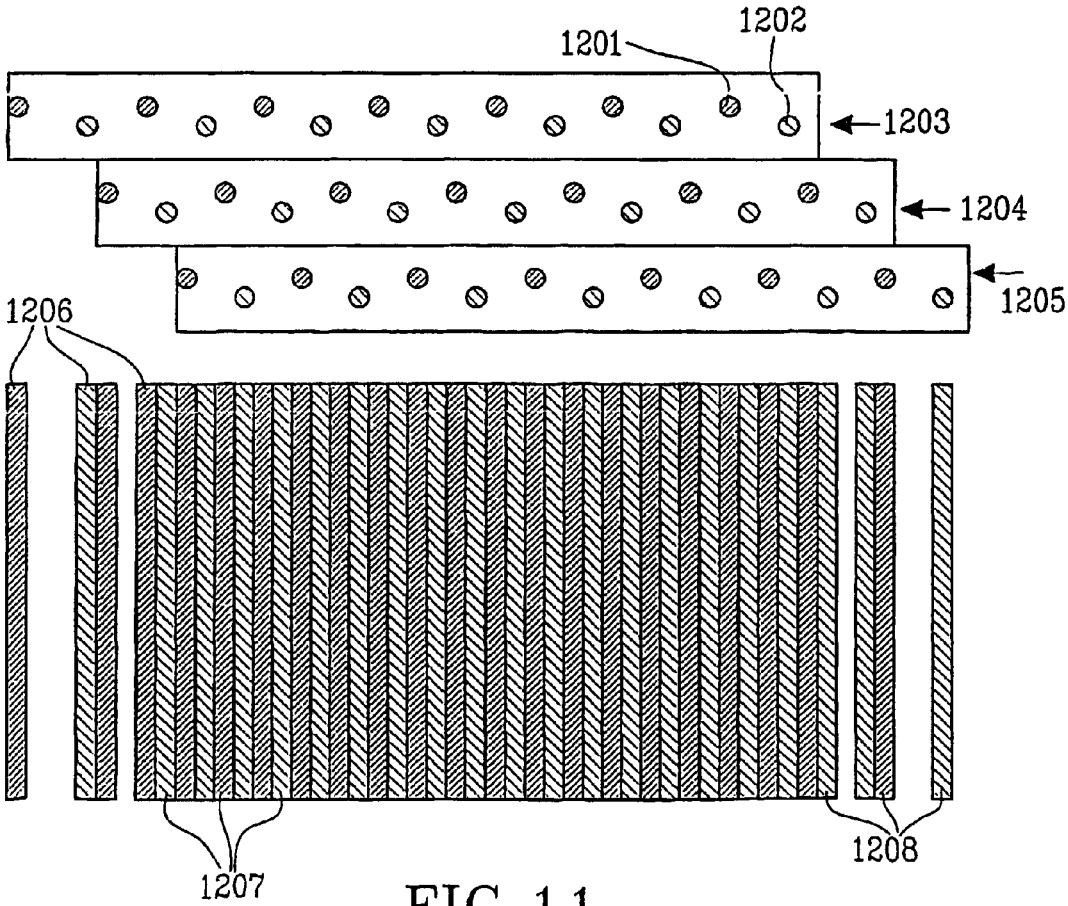
FIG. 11 is a schematic illustration of a third printing pattern.

This is illustrated in FIG. 11 where the printhead structure includes two rows of apertures 1201, 1202. The apertures in one row 1201 are transversely displaced relative the apertures in the other row 1202. The apertures as shown are spaced apart from each other transversely by the same distance, though this is not essential. Each row of apertures includes one sixth of the number of apertures per unit length required to print the complete image so that the two rows of apertures together include one third of the number of apertures per unit length required to print the complete image. The image is printed in three passes of the printhead structure. The positions of the rows of apertures for the first, second and third passes are indicated by 1203, 1204 and 1205 respectively. Between each pass the printhead structure and image receiving surface are moved relative to each other by a distance equal to four times the pitch length L. In FIG. 11 the columns of print printed by the second row of apertures is indicated by shading. Columns printed during the first, second and third passes are indicated by 1206, 1207 and 1208 respectively. As can be seen in FIG. 11, the movement by four times the pitch length results in adjacent columns of print being printed by apertures which belong to different rows.

The rows of apertures may not receive the same quantity of toner particles when printing. Since one row is always upstream or downstream of another row relative to the movement of the toner carrier the row which is upstream will have more toner available than the row which is downstream. The effect of this is that the downstream row or rows may produce dots of a lower density than other rows. If adjacent columns of print are printed by apertures in the same row then the effect of the lower density will be more visible as double width columns of low density will be produced.

Preferably, no two adjacent columns of print are produced by the same row of apertures, since this ensures that the columns of lower density are always spaced from each other and hence are less visible. Although, described with a relative movement between passes of four times the column width the movement could also be eight times the column width. The number and transverse extent of the apertures in the rows is chosen such that not all the apertures in each row are needed to print the intended image. The printing from apertures at the end of the rows which are outside the area to be printed is then suppressed. The apparatus may be arranged such that the non-used apertures are at both ends of the row or rows of apertures and during a pass an aperture or apertures at both ends are simultaneously not used.

Figure 12:
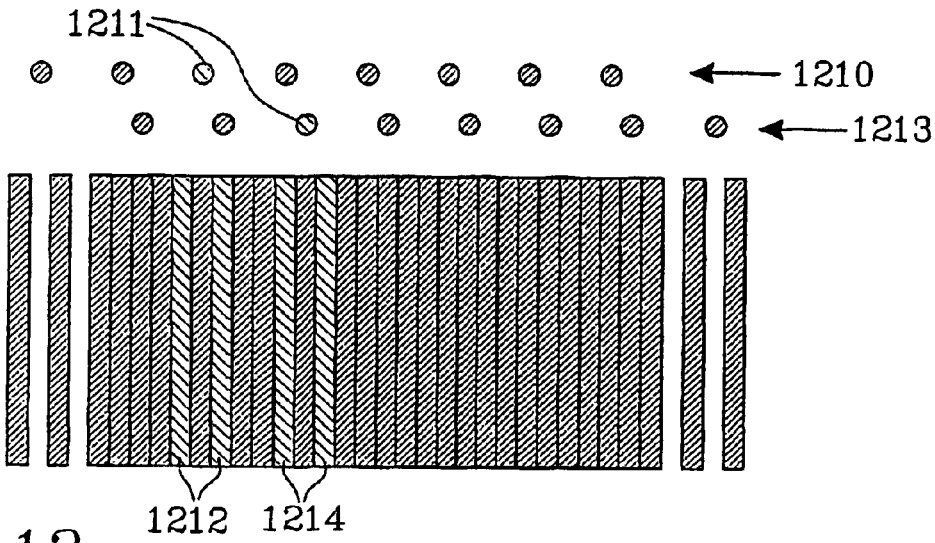
FIG. 12 is a schematic illustration of a fourth printing pattern.

Furthermore, so-called DDC control of the apertures may be used. When DDC control is applied, each aperture is able to print more than one column of print in a single pass. The DDC control is preferably arranged to print columns from a single aperture which are not adjacent to each other, though in a less preferred embodiment they could print adjacent columns in a single pass. In an example (see FIG. 12) the DDC control is arranged to print two non-adjacent columns of print per pass from each aperture, wherein the columns are separated from each other by a distance of twice the pitch length. In FIG. 12 the row of apertures has moved from the first position indicated by reference numeral 1210 in which the first pass took place to the position indicated by reference numeral 1213 in which the second pass took place. The columns printed by a single aperture 1211 are indicated by shaded lines 1212 in the drawing. The position of the aperture 1211 producing the columns is indicated by shading. The aperture in this example produces columns of print that are separated by a single column. The image receiving surface and printhead structure are then moved relative to each other by 5 pitch lengths L in the direction transverse to the direction of movement of the transfer belt, but in the plane of the belt. Then, in a second pass, a second set of columns of the image are printed. The position 1213 of the apertures in the second pass are indicated by the second row of apertures. The columns printed by the aperture 1211 in the second pass are indicated by shaded lines 1214 in the drawing. The printhead structure is moved transversely by an amount equal to N*2+5 number of times the transverse pitch length L, where N is an integer including 0. N will have a maximum value dependent upon the number of apertures and the width of the image to be printed such that the transverse movement leaves enough apertures available to print the image. Thereby, N is equal to 0 so that the relative movement between passes is equal to 5. As can be seen, the relative movement is just sufficient to ensure that the columns printed by a single aperture are not adjacent each other. The relative movement could however be greater than 5, e.g. 7, 9 etc.

Figure 13:
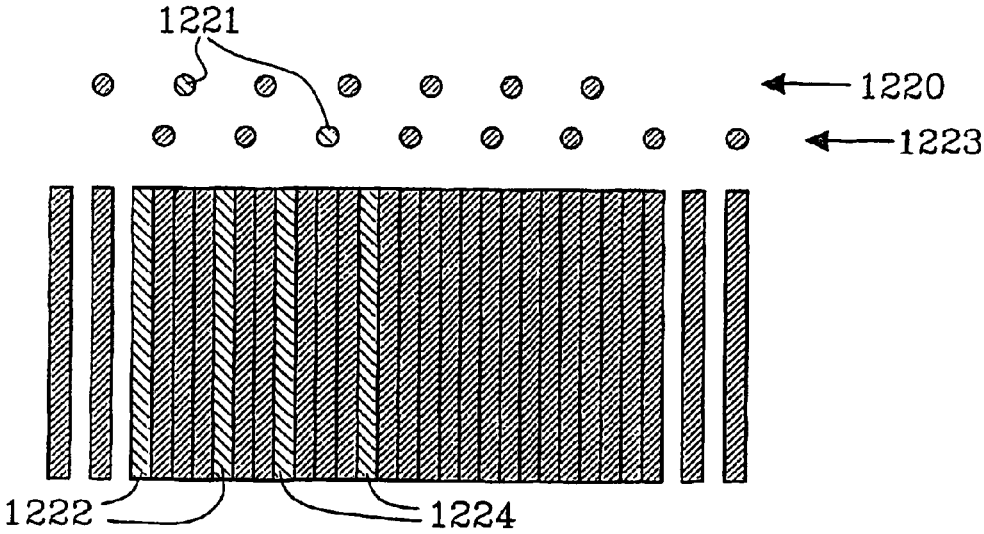
FIG. 13 is a schematic illustration of a fifth printing pattern.

In another example using DDC control (see FIG. 13) each aperture prints two columns of print which are separated from each other by four times the pitch length. In FIG. 13 the row of apertures has moved from the first position indicated by reference numeral 1220 in which the first pass took place to the position indicated by reference numeral 1223 in which the second pass took place. The columns printed by a single aperture 1221 are indicated by shaded lines 1222 in the drawing. The position of the aperture 1221 producing the columns is indicated by shading. The position 1223 of the apertures in the second pass are indicated by the second row of apertures. The columns printed by the aperture 1221 in the second pass are indicated by shaded lines 1224 in the drawing.

Figure 14:
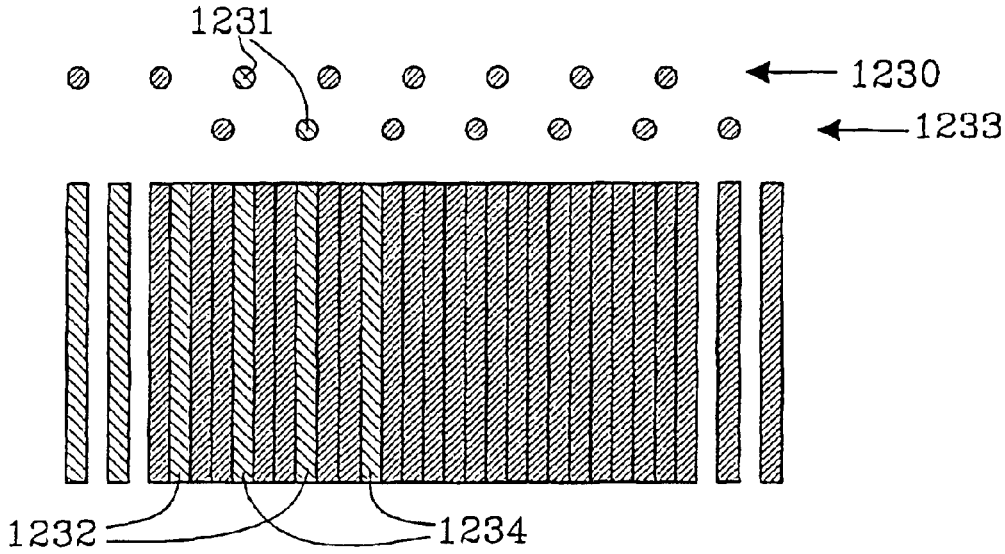
FIG. 14 is a schematic illustration of a sixth printing pattern.
Figure 15:
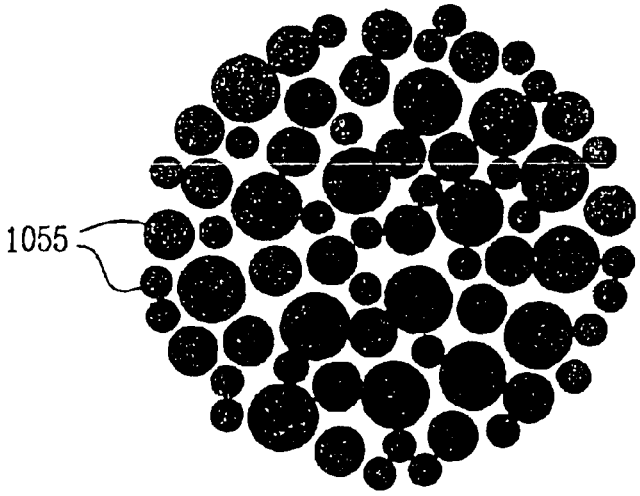
FIG. 15 is a schematic view on an enlarged scale of a printed dot.

In another example, the relative movement is less if the distance between the columns printed in a pass is at least six. In this case the relative movement may be only three pitch lengths. This is possible because the individual columns printed by a single aperture are sufficiently far apart to allow an intermingling of columns printed from different passes by the same aperture. This is illustrated in FIG. 14 where the row of apertures has moved from the first position indicated by reference numeral 1230 in which the first pass took place to the position indicated by reference numeral 1233 in which the second pass took place. The columns 1232 printed from the aperture 1231 on the first pass are printed in hatched shading and the columns 1234 printed on the second pass are printed in differently hatched shading. As is visible in the drawings, columns from one pass intermingle columns from the other pass.

In a further example each aperture prints two columns per line and pass, the distance between the two columns is three times the pitch length and the image is printed in three passes. In this case the relative transverse movement between passes may be 5, 7 or more times the pitch length, according to the formula N*3+5 or N*3+7, where N is an integer including 0.

In yet another example each aperture prints three columns per line and pass, the distance between the three columns is two times the pitch length and the image is printed in two passes. In this case the relative transverse movement between passes may be 7, 9 or more times the pitch length according to the formula N*2+7, where N is an integer including 0.

In a further example DDC control is used to print adjacent columns of print. Each aperture prints two adjacent columns so the spacing is one pitch length. The image is printed in two passes. In this case the relative transverse movement between passes may be 6, 10 or more times the pitch length according to the formula N*4+6, where N is an integer including 0.

In still a further example DDC control is used to print adjacent columns of print. Each aperture prints two adjacent columns so the spacing is one pitch length. The image is printed in three passes. In this case the relative transverse movement between passes may be 4, 8 or more times the pitch length according to the formulae N*6+4 or N*6+8, where N is an integer including 0.

In a yet a still further example DDC control is used to print adjacent columns of print. Each aperture prints three adjacent columns so the spacing is one pitch length. The image is printed in two passes. In this case the relative transverse movement between passes may be 9, 15 or more times the pitch length according to the formulae N*6+9, where N is an integer including 0.

It is also possible to use DDC control in combination with multiple rows of apertures. The amount of transverse movement of the printhead structure relative to the image receiving surface is normally greater than the transverse distance between the apertures in the printhead structure. This means that for any one aperture its transverse position during a subsequent pass is beyond the position of the aperture which was transversely adjacent to said one aperture in the previous pass. Alternatively, any one aperture is beyond the position of the aperture which was transversely adjacent to said one aperture in the previous pass plus one, i.e. two passes previously. This means that an aperture passes beyond the position of its neighbor either at the next pass or over next pass.

The transverse spacing of the apertures in the printhead structure may assume any suitable value. Preferably the value is between 1 and 9 times the pitch length more preferably it is between 2 and 6 times the pitch length or less. Even more preferably it is between 3 and 5 times the pitch length.

In the previously discussed FIG. 5, the image receiving member is a drum 2001. The drum rotates about an axis 2201. Around the periphery of the drum are arranged four print stations 2003. The print stations 2003 respectively contain differently colored toner particles, e.g. yellow, cyan and magenta respectively, to allow color printing. The fourth print station contains black toner particles to allow black and white printing. Alternatively, the black print station could be arranged before the color print stations. There is also provided a transfer station 2016, 2017 for transferring the image to another medium. Transfer may be effected by electrostatic attraction or by pressure transfer. A cleaning station (e.g. of the type denoted by reference numeral 1061 in FIG. 2) can be provided for cleaning the printhead structures of toner particles as required. The cleaning station comprises a vacuum source. The vacuum source acts through one or more transversely aligned rows of apertures in the drum so that a suction force may be effected on a printhead structure.

The printhead structure 2005 provided with each print station is of the type illustrated in FIGS. 4*a*–4*c*, i.e. two parallel rows of apertures with constant pitch between the apertures in a row. The apertures of one row are staggered in relationship to the apertures of the other row. The apertures of one row may be centered in the spaces between the apertures of the other row, though they could be arranged eccentrically.

Cleaning of the printhead structures 2005 preferably is performed after each pass. Alternatively, the cleaning is performed after an image has been formed, or after two or more images have been formed.

During a pass each transverse line of the image to be formed on the drum passes the printhead structures in turn. The transverse line then passes the transfer station 2016, 2017. While the drum is rotating it is moved along its axis 2201. The printhead structures and drum are thus moved continuously relatively to each other in the transverse direction parallel to the axis of the drum. Each rotation of the drum causes a pass of the printhead structures. After two or more passes or rotations of the drum during which printing is effected the transfer station starts to transfer the image to paper as soon as the leading edge of the image reaches the fuser unit. This transfer may start before the other parts of the image have passed all the printhead structures. The cleaning station (not shown) is preferably arranged so that cleaning of each printhead structure may be effected on each pass.

The image preferably occupies a major portion of the circumference of the drum, in particular more than 50%, preferably more than 75%. Where the image occupied a sufficient portion of the circumference of the drum, the start of a further pass for the leading edge of an image may start to be printed before the previous pass has been completed by all printhead structures.

The relative transverse movement between or during passes may take on the following values. In a first example for three or four passes and two rows of apertures per printhead structure a step distance of (P+R×P×N+1) or of (P+R×P×N−1) times the pitch length give suitable values for the transverse movement, where P=number of passes, R=number of rows, N is an integer including 0. In a second example for five passes and two rows of apertures per printhead structure a step distance of (P+R×P×N+X) or of (P+R×P×N−X) times the pitch length give suitable values for the transverse movement, where X can take the values: +3, +1, −1, −3. In a third example for two passes and three rows of apertures per printhead structure a step distance of R×P×N−2 is possible. In a fourth example for three passes and three rows of apertures per printhead structure a step distance of R×P×N+X, where X has the values −7 or −5 are possible.

The above examples are particularly useful where the starvation effect leads to a variation in dot density between different rows of apertures on the printhead structure. However, the starvation effect may occur over several adjacent apertures which are spaced from each other in the transverse direction. In this case it may be appropriate to have a larger transverse movement. For example it may be two or more times the extent of the starvation effect. The printhead structure or another part of the printer may include an instrument for measuring the optical density of the image. The instrument may detect the transverse extent of the starvation effect. The output of the instrument may be used to cause a transverse movement sufficient that that the apertures affected by the starvation effect do not print columns adjacent to columns which were formed by the "starving" apertures in a preceding pass.

After a number of passes the direction of movement of the drum relative to the printhead structures will be reversed. To effect this a pass without any printing is performed during which the direction of movement is changed. Preferably the change in direction takes place after one image has been completed and before another image is commenced. A pass without printing may also be made where it is desired to change the speed and/or pattern of the transverse motion of the drum.

The transfer drum 2001 can be formed of an electrically conducting material. The material may optionally be covered on its surface facing outwardly towards the toner carrier with a thin layer of an electrically insulating material, preferably less than 100 microns thick. The electrically conducting material is preferably a metal though any material is possible so long as it conducts electricity. The metal is preferably aluminum. The thin layer of insulating material is sufficiently thin that the electric field lines pass through sufficiently to allow a mirror charge to be formed which mirrors the charge on the toner on the surface of the transfer belt or drum. This mirror charge increases the force holding the charged toner to the transfer belt or drum. The insulating materials may be any suitable material, in particular aluminum oxide. The aluminum oxide may be combined with any conducting material for the drum, but is particularly advantageous when used with a drum with an aluminum surface. The above form of drum is particularly useful when the transfer of the image is to be effected by pressure as the stronger material of the drum allows a higher pressure to be used.

This form of drum is particularly useful with a multipass printer as hereinbefore described, but may be used with other types of printers, particularly those with high surface speeds of the drum or belt.

In any of the above-discussed examples, the pitch (distance between centers of dots) may be varied. The distance between dots on the transverse lines (horizontal pitch) may be varied and/or the distance between dots in a longitudinal column (vertical pitch) may be varied. The horizontal pitch may be varied by varying the amount of relative transverse movement between passes. The vertical pitch can be varied by varying the amount of longitudinal movement between the printing of lines.

The back electrode member or members utilized in an image forming apparatus can be of a number of different types, e.g. a stationary or rotating roll or sleeve, or a movable belt arranged in an endless loop by means of guide rolls. Depending on the application, the back electrode member can be made of different materials, e.g. a suitable metal alloy or another electrically conductive material. Furthermore, a back electrode member can be arranged behind a belt constituting an intermediate image receiving member.

It is also conceivable with embodiments where a suitable information carrier, such as a printing paper, passes across the back electrode when printing so that an image is printed directly onto the information carrier, or where the information carrier also constitutes the back electrode by means of being electrically conductive.

In other applications, an intermediate image is formed directly onto the surface of the back electrode member, whereafter the image is transferred to a suitable image receiving substrate such as a printing paper. It is particularly advantageous to print directly onto the back electrode in applications utilizing so-called multi-interlacing (MIC) techniques.

Furthermore, it is conceivable with applications where the electrical field, by means of which the toner particles are transported, is generated by another means than a pair of electrodes, e.g. applications where the electrical field is generated by means of a suitable charge carrier which in itself is able to generate an electrostatic field.

In order to provide a high print quality and sharpness of the printed characters the present invention suggests that there should be enough amount of toner particles in each dot at least for a part of the image location areas. The amount of toner particles should be of a sufficient number at least in every full optical density dot. Full optical density is defined as an optical density of at least 1.4 measured with the following instrument: Macbeth R D 914 from Kollmogen Instruments Corp., PO Box 1297, Newburgh N.Y. 12550, U.S.A. Half optical density is defined as an optical density of about 0.7 measured as above.

According to the invention at least 35 charged toner particles should be addressed to each dot at least for a part of the image location areas. It is preferred that at least for every full optical density dot at least 35 charged toner particles is addressed per dot. It is by that ensured the number of toner particles in the respective dot is sufficient for providing a distinct edge sharpness in that dot.

According to another aspect of the invention the projected area of charged particles on the image receiving surface before fusing in fuser unit 1013 should at least for a part of the image location area for, preferably at least for full optical density, be at least 0.5 times the printed area of said image receiving surface. After fusing in fuser unit 1013 the projected area should at least for a part of the image location area, preferably at least for full optical density, be at least 0.8 times the printed area of said image receiving surface. The projected area of the toner particles can be easily measured in a microscope.

According to a further aspect of the invention each printed dot at 600*600 dpi (dots per square inch) contains a number of at least 35 charged toner particles for full optical density. For half optical density the number of charged toner particles should be at least 15 and preferably at least 25 for each printed dot at 600*600 dpi.

According to another embodiment of the invention the number of charged toner particles for 300*300 dpi and full optical density should be at least 140 for each printed dot, and for half optical density the number should be at least 50 and preferably at least 70 for each printed dot.

According to a further embodiment the dot size is at least 400*400 dpi (dots per square inch).

The number of particles for each dot is calculated in a microscope. FIG. 5 schematically illustrates on an enlarged scale a printed dot in which the toner particles are denoted with the numeral 1055.

The amount of toner particles transported through the apertures 1052 to the image receiving surface during each print sequence is controlled by a control unit (not shown) comprising variable control voltage sources connected to the control electrodes 1053 to supply control potentials. In order to fulfill the criteria of the present invention with respect to the number of toner particles in each printed dot one also has to consider the particle size of the toner particles. It is preferred that the average diameter of the toner particles is in the range of 3–8 microns.

The toner particles are preferably non magnetic toner particles.

The amount of toner particles delivered at each print sequence is further determined by the length of the print sequence, which may be controlled by the relative movement of the image receiving surface with respect to the printhead structure. The so-called multi-pass technique described above may also be utilized in order to deliver a sufficient amount of toner particles at each print sequence.

The present invention is not limited to the embodiments described above but may be varied within the scope of the appended patent claims.

What is claimed is:

1. An image forming apparatus, in which an image information is converted into a pattern of electrostatic fields for modulating a transport of charged toner particles from a particle carrier towards an image receiving surface, said image forming apparatus including:

a background voltage source for producing a background electric field which enables a transport of charged toner particles from said particle carrier towards said image receiving surface;

a printhead structure arranged in said background electric field, including a plurality of apertures and control electrodes arranged in conjunction to the apertures;

control voltage sources for supplying control potentials to said control electrodes in accordance with the image information to selectively permit or restrict the transport of charged toner particles from the particle carrier through the apertures;

said image receiving surface being arranged for movement in relation to the printhead structure for intercepting the transported charged toner particles in an image configuration;

control means being arranged for controlling the amount of charged toner particles addressed to the respective dot location of said image receiving surface;

characterized in that said control means is arranged to address an amount of charged toner particles corresponding to at least 35 charged toner particles per addressed dot at least for a part of the image location areas.

2. An image forming apparatus according to claim 1, characterized in that said control means is arranged to address an amount of charged toner particles corresponding to $2*10^{10}$ particles/$m^2$ image location area ($2*10^4$ particles/$mm^2$ image location area) at least for a part of the image location area.

3. An image forming apparatus according to claim 2, characterized in that for full optical density said control means is arranged to address an amount of charged toner particles corresponding to $2*10^{10}$ particles/$m^2$ image location area ($2*10^4$ particles/$mm^2$ image location area).

4. An image forming apparatus according to claim 1, characterized in that said control means is arranged to address an amount of charged toner particles so that the projected area of said particles on the image receiving surface before fusing is at least 0.5 times the image location area of said image receiving surface at least for a part of the image location area.

5. An image forming apparatus according to claim 4, characterized in that for full optical density said control means is arranged to address an amount of charged toner particles so that the projected area of said particles on the image receiving surface before fusing is at least 0.5 times the image location area of said image receiving surface.

6. An image forming apparatus according to claim 1, characterized in that the projected area of said charged toner particles after fusing is at least 0.8 times the image location area of said image receiving surface at least for a part of the image location areas.

7. An image forming apparatus according to claim 6, characterized in that for full optical density the projected area of said charged toner particles after fusing is at least 0.8 times the image location area of said image receiving surface.

8. An image forming apparatus according to claim 1, characterized in that said control means for full optical density is arranged to address at least 35 charged toner particles per addressed dot at 600*600 dpi (dots per square inch).

9. An image forming apparatus according to claim 8, characterized in that said control means for half optical density is arranged to address at least 15 and preferably at least 25 charged toner particles per addressed dot at 600*600 dpi (dots per square inch).

10. An image forming apparatus according to claim 9, characterized in that said control means for half optical density is arranged to address at least 50 and preferably at least 70 charged toner particles per addressed dot at 300*300 dpi (dots per square inch).

11. An image forming apparatus according to claim 1, characterized in that said control means for full optical density is arranged to address at least 140 charged toner particles per addressed dot at 300*300 dpi (dots per square inch).

12. An image forming apparatus according to claim 1, characterized in that the dot size is at least 400*400 dpi (dots per square inch).

13. An image forming apparatus according to claim 1, characterized in that said toner particles are non magnetic.

14. An image forming apparatus according to claim 1, characterized in that the apparatus further comprises a back electrode, wherein the image receiving surface is a first face of the back electrode from which the toner particles in said image configuration can be transferred to an information carrier.

15. An image forming apparatus according to claim 1, characterized in that the image receiving surface is a first face of an information carrier which also acts as a back electrode.

16. An image forming apparatus according to claim 1, characterized in that the apparatus further comprises an intermediate image receiving member and a back electrode, wherein the image receiving surface is a first face of the intermediate image receiving member and the back electrode is located facing a second face of the intermediate image receiving member, so that the toner particles in said image configuration can be transferred from the first face of the intermediate image receiving member to an information carrier.

17. An image forming apparatus according to claim 1, characterized in that the apparatus further comprises a back electrode, wherein the image receiving surface is a first face of an information carrier and the back electrode is located facing a second face of the information carrier.

18. An image forming method in which an image information is converted into a pattern of electrostatic fields including:

modulating a transport of charged toner particles from a particle carrier towards an image receiving surface;

producing a background electric field to enable a transport of said charged toner particles from said particle carrier towards said image receiving surface;

providing an apertured printhead structure in said background electric field, and control electrodes arranged in conjunction to the apertures;

connecting voltage sources to said control electrodes to supply control potentials to said control electrodes produce a pattern of electrostatic fields in accordance with the image information to selectively permit or restrict the transport of charged toner particles from the particle carrier through the apertures; and conveying said image receiving surface in relation to the printhead structure for intercepting the transported charged toner particles in image configuration;

controlling the amount of charged toner particles addressed to the respective dot location of said image receiving surface;

characterized in controlling the amount of charged toner particles so as to address an amount to the respective dot location so that at least 35 charged toner particles are addressed per dot at least for a part of the image location areas.

19. An image forming method according to claim 18, controlling the amount of charged toner particles so as to address an amount corresponding to $2*10^{10}$ particles/$m^2$ image location area ($2*10^4$ particles/$mm^2$ image location area) at least for a part of the image location areas.

20. An image forming method according to claim 19, characterized in controlling the amount of charged toner particles so as for full optical density address an amount corresponding to $2*10^{10}$ particles/$m^2$ image location area ($2*10^4$ particles/$mm^2$ image location area).

21. An image forming method according to claim 19, characterized in controlling the amount of charged toner particles so as to address an amount of charged toner particles so that the projected area of said particles on the image receiving surface before fusing is at least 0.5 times the image location area of said image receiving surface at least for a part of the image location areas.

22. An image forming method according to claim 21, characterized in controlling the amount of charged toner particles so as for full optical density address an amount of charged toner particles so that the projected area of said particles on the image receiving surface before fusing is at least 0.5 times the image location area of said image receiving surface.

23. An image forming method according to claim 18, characterized in controlling the amount of charged toner particles addressed to the respective dot location so that the projected area of said charged toner particles after fusing is at least 0.8 times the image location area of said image receiving surface at least for a part of the image location areas.

24. An image forming method according to claim 23, characterized in controlling the amount of charged toner particles so as for full optical density address an amount of charged toner particles so that the projected area of said particles on the image receiving surface after fusing is at least 0.8 times the image location area of said image receiving surface.

25. An image forming method according to claim 18, characterized in controlling the amount of charged toner particles addressed to the respective dot location so that for full optical density at least 35 charged toner particles are addressed per dot at 600*600 dpi (dots per square inch).

26. An image forming method according to claim 25, characterized in controlling the amount of charged toner particles addressed to the respective dot location so that for half optical density at least 15 and preferably at least 25 charged toner particles are addressed per addressed dot at 600*600 dpi (dots per square inch).

27. An image forming method according to claim 18, characterized in controlling the amount of charged toner particles addressed to the respective dot location so that for full optical density at least 140 charged toner particles are addressed per addressed dot at 300*300 dpi (dots per square inch).

28. An image forming method according to claim 27, characterized in controlling the amount of charged toner particles addressed to the respective dot location so that for half optical density at least 50 and preferably at least 70 charged toner particles are addressed per addressed dot at 300*300 dpi (dots per square inch).

29. An image forming method according to claim 18, characterized in that the dot size is at least 400*400 dpi (dots per square inch).

30. An image forming method according to claim 18, characterized in that said toner particles are non magnetic.

* * * * *